US012392103B2

(12) United States Patent
Kaufman et al.

(10) Patent No.: US 12,392,103 B2
(45) Date of Patent: Aug. 19, 2025

(54) SNAP LOCK, ANTI-REVERSE ROTATION COUPLER ASSEMBLY FOR FOUNDATION SUPPORT SYSTEM

(71) Applicant: PIER TECH SYSTEMS, LLC, Chesterfield, MO (US)

(72) Inventors: Kevin Kaufman, Des Peres, MO (US); Michael D. Wilkis, Ellisville, MO (US)

(73) Assignee: Pier Tech Systems, LLC, Chesterfield, MO (US)

( * ) Notice: Subject to any disclaimer, the term of this patent is extended or adjusted under 35 U.S.C. 154(b) by 145 days.

(21) Appl. No.: 18/351,613

(22) Filed: Jul. 13, 2023

(65) Prior Publication Data

US 2024/0035245 A1 Feb. 1, 2024

Related U.S. Application Data

(60) Provisional application No. 63/394,073, filed on Aug. 1, 2022.

(51) Int. Cl.

| | |
|---|---|
| ***E02D 5/52*** | (2006.01) |
| ***E02D 5/56*** | (2006.01) |
| ***E02D 27/12*** | (2006.01) |

(52) U.S. Cl.

CPC ..... *E02D 5/526* (2013.01); *E02D 5/56* (2013.01); *E02D 2300/0029* (2013.01); *E02D 2600/20* (2013.01)

(58) Field of Classification Search

CPC .. E02D 5/526; E02D 5/56; E02D 7/22; E02D 2600/20; E02D 5/285; E02D 7/12

See application file for complete search history.

(56) References Cited

U.S. PATENT DOCUMENTS

| | | | |
|---|---|---|---|
| 1,080,674 | A | 12/1913 | Berg |
| 1,080,675 | A | 12/1913 | Berg |
| 3,813,115 | A | 5/1974 | French |
| 9,453,318 | B2 | 9/2016 | Kemp et al. |
| 9,458,593 | B2 | 10/2016 | Hale |
| 9,863,114 | B2 | 1/2018 | Kaufman et al. |

(Continued)

FOREIGN PATENT DOCUMENTS

| | | | |
|---|---|---|---|
| AU | 2013204548 B2 | | 5/2013 |
| CN | 111395326 A | * | 7/2020 |

(Continued)

OTHER PUBLICATIONS

PCT International Search Report and Written Opinion issued for application No. PCT/US2021/017862, dated May 31, 2021 (9 pages).

(Continued)

*Primary Examiner* — Amber R Anderson
*Assistant Examiner* — Stacy N Lawson
(74) *Attorney, Agent, or Firm* — Armstrong Teasdale, LLP

(57) ABSTRACT

A coupled shaft assembly for a foundation support system includes inner and outer couplers with mating helical ribs and grooves, and spring element that resiliently interlocks the inner and outer couplers in an axial direction. Built-in anti-reverse rotation elements in each coupler accommodates a limited degree of relative rotation of the couplers and thereafter precludes further relative rotation that could otherwise negatively impact the spring element and lead to an undesirable disengagement of the inner and outer couplers.

25 Claims, 14 Drawing Sheets

(56) References Cited

U.S. PATENT DOCUMENTS

| | | | | |
|---|---|---|---|---|
| 2004/0076479 | A1 | 4/2004 | Camilleri | |
| 2015/0071712 | A1* | 3/2015 | Kemp | E02D 5/56 405/251 |
| 2018/0030681 | A1* | 2/2018 | Stroyer | E02D 5/36 |
| 2019/0249387 | A1* | 8/2019 | Horie | E02D 5/24 |
| 2022/0136200 | A1* | 5/2022 | Kitamura | E02D 5/526 405/251 |

FOREIGN PATENT DOCUMENTS

| | | | |
|---|---|---|---|
| DE | 10055348 | A1 | 5/2002 |
| EP | 2505896 | A2 | 10/2012 |
| JP | 2001311143 | A | 11/2001 |
| JP | 2018066152 | A | 4/2018 |
| KR | 2020102637 | A | 2/2022 |

OTHER PUBLICATIONS

Extended European Search Report issued for Application No. 23188333.1, dated Dec. 22, 2023 (9 pages).

* cited by examiner

STATE OF THE ART

STATE OF THE ART

STATE OF THE ART

SNAP LOCK, ANTI-REVERSE ROTATION COUPLER ASSEMBLY FOR FOUNDATION SUPPORT SYSTEM

CROSS REFERENCE TO RELATED APPLICATIONS

This application claims the benefit of U.S. Provisional Application Ser. No. 63/394,073 filed Aug. 1, 2022, the complete disclosure of which is hereby incorporated by reference in its entirety.

This application further relates in part to subject matter disclosed in U.S. application Ser. No. 17/174,805 filed Feb. 12, 2021, which claims the benefit of U.S. Provisional Application Ser. No. 62/976,442 filed Feb. 14, 2020, the entire disclosures of which are hereby incorporated by reference in their entirety.

BACKGROUND OF THE INVENTION

The field of the invention relates generally to building foundation support systems including assemblies of coupled structural support shaft components, and more specifically to improved torque transmitting couplings for foundation support shaft components such as helical piers.

If a building foundation moves or settles in the course of construction, or at any time after construction is completed, such movement or settlement may affect the integrity of the building structure and lead to costly repairs. While much care is taken to construct stable foundations in new building projects, certain soil types or other building site conditions, or certain types of buildings or structures, may present particular concerns that call for additional measures to ensure the stability of building foundations.

Helical piers, also known as anchors, piles or screw piles, are deep foundation solutions commonly used when standard foundation solutions are problematic. Helical piers are driven into the ground with reduced installation time and little soil disturbance compared to large excavation work that may otherwise be required by standard foundation techniques, and a number of helical piers may be installed at designated locations to transfer and distribute the weight of the building structure to load bearing soil to prevent the foundation from moving or shifting. Lifting elements, support brackets or load-bearing caps may be used in combination with the helical piers to construct various types of foundation support systems meeting different needs for both foundation repair and new construction applications.

While known foundation support systems are satisfactory in many aspects, improvements are nonetheless desired.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

In order to understand the inventive concepts described herein to their fullest extent, some discussion of the state of the art and certain problems and disadvantages that exist in the art is set forth below, followed by exemplary embodiments of improved foundation support systems and components therefore which overcome such problems and disadvantages in the art.

Figure 1:
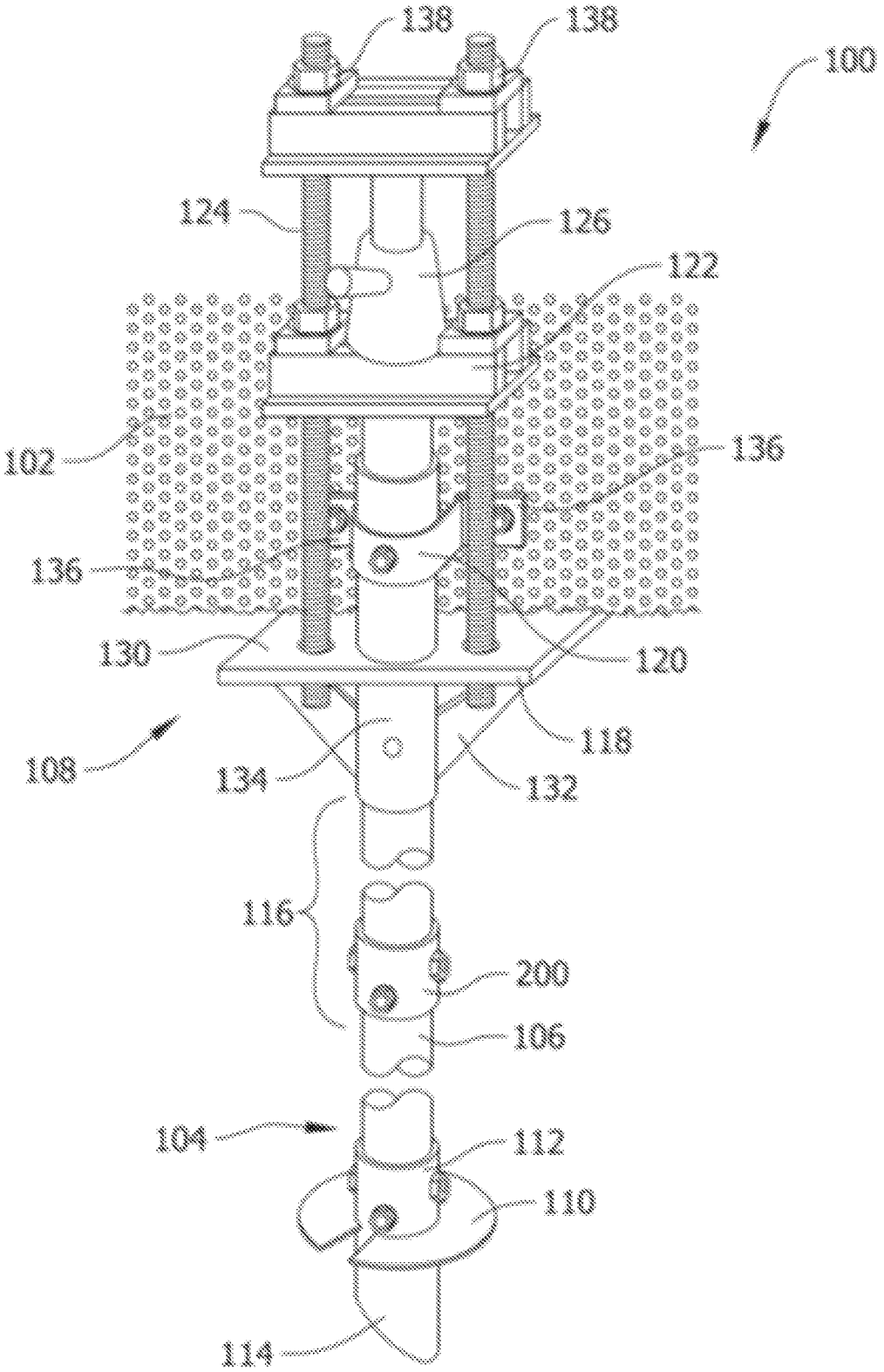
FIG. 1 is a perspective view of a conventional foundation support system interacting with a building structure.

FIG. 1 illustrates a perspective view of a conventional foundation support system 100 in combination with a building foundation 102 which in turn supports a structure in residential, commercial or industrial construction site. The structure being supported by the building foundation 102 may include various types of buildings, homes, edifices, etc. in real estate developments and improvements. The foundation support system 100 may be applied in the new construction of the building foundation 102 prior to the structure being completed, or may alternatively be applied for maintenance and repair purposes in a retrofit manner to a pre-existing building foundation at any desired time after the foundation 102 and building structure are initially constructed. While exemplary structures are mentioned above, the foundation support system 100 may be used in a similar manner to provide foundation support for various different types of structures and to securely support anticipated structural loads without more extensive excavation that standard building foundations otherwise require to provide a similar degree of support. The foundation support system described and illustrated herein is therefore a non-limiting example of the type of system that may be benefit from the inventive concepts described further below.

Primary piles or pipe shafts (hereinafter collectively referred to as a "pile" or "piles") 104 of appropriate size and dimension may be selected and may be driven into the ground or earth at a location proximate or near the foundation 102 using known methods and techniques. The size of the primary pile 104 and the insertion depth needed to provide the desired support may be determined according to known engineering methodology and analysis of the construction site and the particular structure that is to be supported. The primary piles 104 typically consist of a long shaft 106 that is driven into the ground to the desired depth, and a support element such as a plate or bracket (not shown) or a lifting element such as a lifting assembly 108 may be assembled to the shaft 106 proximate the foundation 102. The shaft 106 of the primary pile 104 may also include one or more lateral projections such as a helical auger 110. Such helical steel piles 104 are available from, for example, Pier Tech Systems (www.piertech.com) of Chesterfield, Missouri.

The helical auger 110 may in some embodiments be separately provided from the piling 104 and attached to the piling 104 by welding to a sleeve 112 including the auger 110 provided as a modular element fitting. As such, the sleeve 112 of the modular fitting may be slidably inserted over an end of the shaft 106 of the piling shaft 104 and secured into place with fasteners such as bolts as shown in FIG. 1. In such an embodiment, the sleeve 112 includes one or more pairs of fastener holes or openings for attachment to the piling shaft 106 with the fasteners shown. In the embodiment illustrated there are two pairs of fastener holes formed in the sleeve 112, which are aligned with corresponding fastener holes in the shaft 106 to accept orthogonally-oriented fasteners and establish a cross-bolt connection between the shaft 106 and the sleeve 112. To make a primary pile 104 with a particular length one merely slides the sleeve 112 onto a piling shaft 106 of the desired length and affixes the sleeve 112 in place. In the illustrated embodiment, the end of the piling shaft 106 is provided with a beveled tip 114 to better penetrate the ground during installation of the pile 104. In different embodiments, the tapered tip 114 may be provided on the shaft 106 of the piling 104, or alternatively, the tip 114 may be a feature of the modular fitting including the sleeve 112 and the auger 110.

The lifting assembly 108 may be attached to an upper end of the primary pile 104 after being driven into the ground. If the primary pile 104 is not sufficiently long enough to be driven far enough into the ground to provide the necessary support to the foundation 102, one or more extension piles 116 can be added to the primary pile 104 to extend its length in the assembly. The lifting assembly 108 may then be attached to one of the extension piles 116.

As shown in FIG. 1, the lifting assembly 108 interacts with the foundation 102 to support and lift the building foundation 102. In a contemplated embodiment, the lifting assembly 108 may include a bracket body 118, one or more bracket clamps 120 and accompanying fasteners, a slider block 122, and one or more supporting bolts 124 which may be all thread rods, for example, and accompanying hardware. In another suitable embodiment the lifting assembly 108 may also include a jack 126 and a jacking block 128. Suitable lifting assemblies may correspond to those available from Pier Tech Systems (www.piertech.com) of Chesterfield, Missouri, including for example only the TRU-LIFT® bracket of Pier Tech Systems, although other lifting assemblies, lift brackets, and lift components from other providers may likewise be utilized in other embodiments.

The bracket body 118 in the example shown includes a generally flat lift plate 130, one or more optional gussets 132, and a generally cylindrical housing 134. The lift plate 130 is inserted under and interacts with the foundation or other structure 102 that is to be lifted or supported. The lift plate 130 includes an opening, with which the cylindrical housing 134 is aligned to accommodate one of the primary pile 104 or an extension pile 116. The housing 134 is generally perpendicular to the surface of lift plate 130 and extends above and below the plane of lift plate 130.

In the example shown, one or more gussets 132 are attached to the bottom surface of the lift plate 130 as well as to the lower portion of the housing 134 to increase the holding strength of the lift plate 130. In one embodiment, the gussets 132 are attached to the housing 134 by welding, although other secure means of attachment are encompassed within this invention.

In the example shown, the bracket clamps 120 include a generally Ω-shaped piece having a center hole at the apex of the "Ω" to accommodate a fastener. The Ω-shaped bracket clamp 120 includes ends 136, extending laterally, that include openings to accommodate fasteners. The fasteners extending through the openings in the ends 136 are attached to the foundation 102, while the fastener extending through the center opening at the apex of the "Ω" extends into an opening in the housing 134. In one embodiment the fastener extending through the center opening in the bracket clamp 120 and into the housing 134 further extends through one of the primary pile 104 or the extension pile 116 and into an opening on the opposite side of the housing 134, and then anchors into the foundation 102. In such cases, however, the fastener is not inserted through one of the primary pile 104 or the extension pile 116 until jacking or lifting has been completed, since bracket body 118 must be able to move relative to pile 104 or 116 in order to effect lifting of the foundation 102.

In one embodiment, the bracket body 118 is raised by tightening a pair of nuts 138 attached to the top ends of the supporting bolts 124. The nuts 138 may be tightened simultaneously, or alternatively, in succession in small increments with each step, so that the tension on the bolts 124 is kept roughly equal throughout the lifting process. In another suitable embodiment, the jack 126 is used to lift the bracket body 118. In this embodiment, longer support bolts 124 are provided and are configured to extend high enough above the slider block 122 to accommodate the jack 126 resting on the slider block 122, the jacking block 128, and the nuts 138.

When all of the components are in place as shown and sufficiently tightened, the jack 126 (of any type, although a hydraulic jack is preferred) is activated so as to lift the jacking plate 128. As the jacking plate 128 is lifted, force is transferred from the jacking plate 128 to the support bolts 124 and in turn to the lift plate 130 of the bracket body 118. When the foundation 102 has been lifted to the desired elevation, the nuts immediately above the slider block 122 (which are raised along with support bolts 124 during jacking) are tightened down, with approximately equal tension placed on each nut. At this point, the jack 126 can then be lowered while the bracket body 118 will be held at the correct elevation by the tightened nuts on the slider block 122. The jacking block 128 can then be removed and reused. The extra support bolt material above the nuts at the slider block 122 can be removed as well, using conventional cutting techniques.

The lifting assembly 108 and related methodology is not required in all implementations of the foundation support system 100. In certain installations, the foundation 102 is desirably supported and held in place but not moved or lifted, and in such installations the lifting assembly shown and described may be replaced by a support plate, support bracket or other element known in the art to hold the foundation 102 in place without lifting it first. Support plates, support brackets, support caps, and or other support components to hold a foundation in place are available from Pier Tech Systems (www.piertech.com) of Chesterfield, Missouri and other providers, any of which may be utilized in other embodiments of the foundation support system.

As mentioned, it is sometimes necessary to extend the length of a piling by connecting one or more shafts which in combination may provide support that extends deeper into the ground than the shafts individually can otherwise reach. For example, a first helical pier component, referred to as a primary pile, may be driven nearly fully into the ground at the desired location, and a connection component such as an extension pile may then be attached to the end of the primary pile in order to drive the primary pile deeper into the ground while supporting the building foundation at an end of the extension pile. More than one extension pile may be required depending on the lengths of the piles available and/or particular soil conditions.

Figure 2:
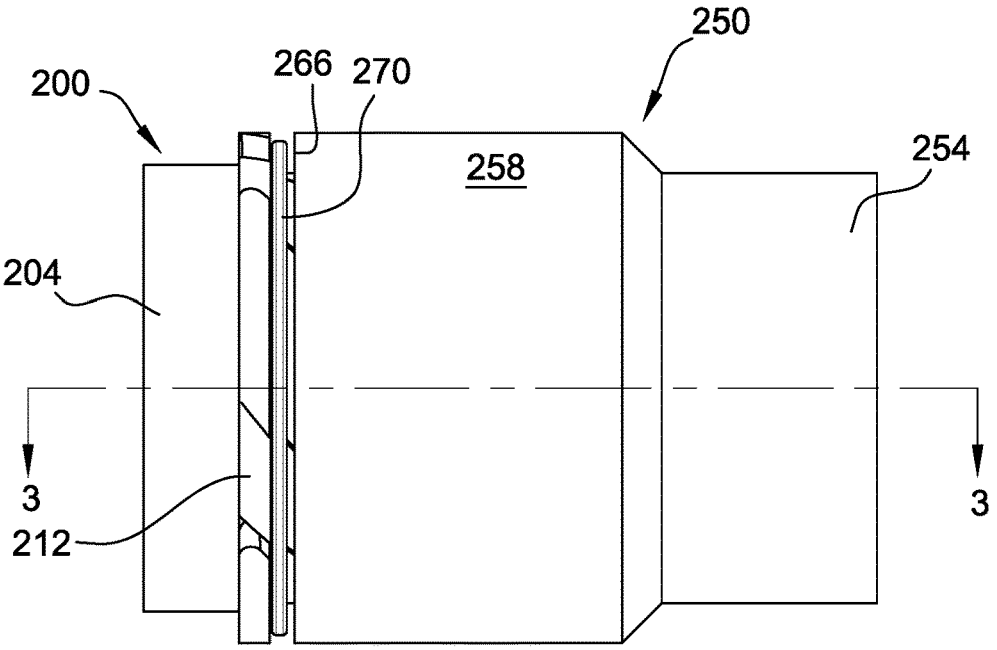
FIG. 2 is a side view of a conventional coupler and shaft assembly for the foundation support system shown in FIG. 1.
Figure 3:
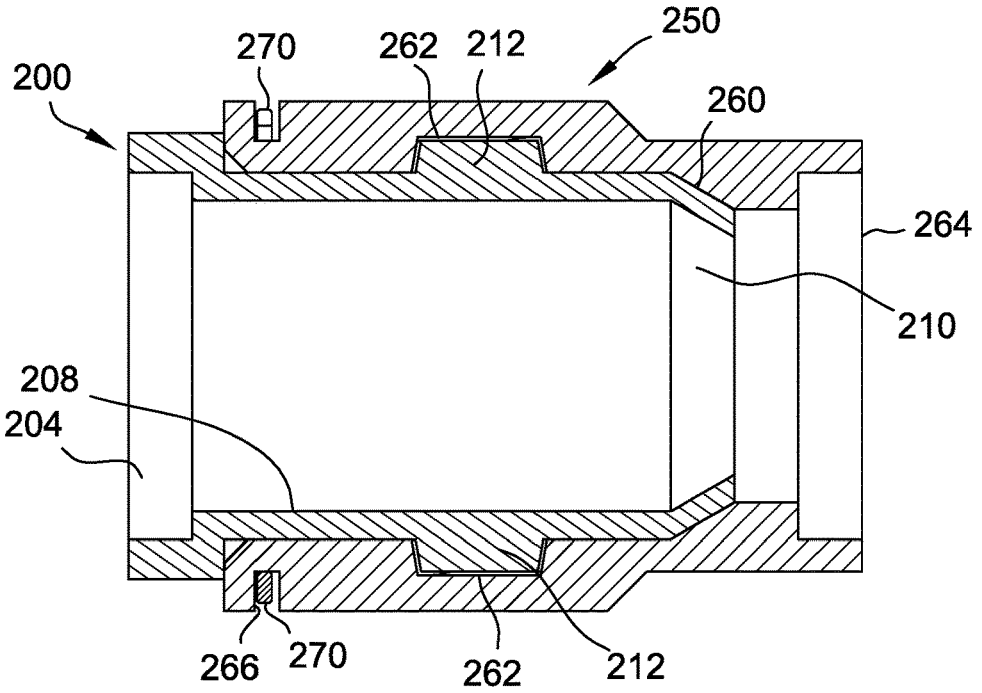
FIG. 3 is a cross sectional view of the mated components shown in FIG. 2.

FIGS. 2 and 3 are a side view and sectional view, respectively, of a coupler assembly that overcomes some of the drawbacks of prior couplers for foundation support systems such as that shown in FIG. 1. Specifically, FIGS. 2 and 3 illustrate a snap-lock coupler system in the form of couplers 200, 250 that advantageously avoid any need for separately provided fasteners such as bolts to interconnect shafts associated with each respective coupler 200, 250. The coupler 200 includes a shaft receiving end 204 for a first shaft, and the coupler 250 includes a shaft receiving end 254 for a second shaft. The shafts associated with each coupler 200, 250 may be, for example, primary piles and/or extension piles in the foundation support system. In lieu of bolts to maintain an engagement of the couplers 200, 250 an annular spring element 270 is provided on the coupler 250 that automatically operates with snap-action engagement to axially interlock the couplers 200, 250 to one another.

The coupler 250 is formed with a main body 258 defining a central passageway or bore having an inner surface with an inner diameter about equal to, but slightly larger than the outer diameter of a main body 208 of the coupler 200. The coupler 250 includes a circumferential retaining groove 266 formed in its outer surface adjacent a distal end of the coupler, and the annular spring retainer element 270 extends in the retaining groove 266.

The main body 208 of the coupler 200 is formed with a number of outwardly projecting spaced apart and helically extending ribs 212 that are mated with complementary helical grooves 262 formed on an inner surface of the main body 258 of the coupler 250. As the couplers 200, 250 are mated, the ribs 212 deflect the annular spring retainer element 270 to enlarge its diameter until the spring retainer element 270 resiliently snaps back to its original diameter. After snapping back to the original diameter, the spring retainer element 270 extends in a combination of the retaining groove 266 of the coupler 250 and an aligned retaining groove formed in the coupler 200.

By virtue of the snap-action engagement of the couplers 200, 250 the assembly of the couplers to make the desired interconnections of shafts is simplified, and issues associated with conventional separately provided fasteners such as bolts to make the desired interconnections of the shafts through the couplers is avoided. The spring retainer element 270 provides an axial interlock of the engaged couplers 200, 250 while the ribs 212 and grooves 3+3 simultaneously provide both axial and rotational interlock of the couplers 200, 250. Because the helical ribs 212 and grooves 262 distribute any uplift forces in the mated outer and inner surfaces of the couplers 200, 250, the spring retainer element 270 may be smaller and lighter than it otherwise may need to be if it exclusively bore all of the uplift forces that may be presented.

The snap-lock coupler system shown in FIGS. 2 and 3 is more completely described in U.S. Patent Application Publication No. 2021/0254298 of Pier Tech Systems. The reader is therefore referred to the same for further details.

While the snap-lock couplers 200, 250 solve significant problems presented in conventional foundation support systems and work well in certain installations, the present inventors have realized certain limitations presented in the snap-lock couplers 200, 250 for certain end-use installations and installation methods. Specifically, the mated helical ribs 212 and helical grooves 262 in the couplers 200, 250 were designed and intended to provide secure rotational interlock to transmit torque in either direction (forward or reverse) to drive a piling deeper into the ground or to partially or completely withdraw it from the ground, without requiring a separately fastener such as a bolt to complete the torque transmitting connection. While the inventors confirm that the mated helical ribs 212 and helical grooves 262 in the couplers 200, 250 do provide secure rotational interlock to transmit torque in a forward direction as a helical pile is being driven into the ground, when the coupler assembly is subjected to reverse rotation a relative rotation of the couplers 200, 250 is possible. That is, the expected rotational interlock of the couplers 200, 250 in reverse rotation is not necessarily present, and relative reverse rotation of the couplers 200, 250 with respect to one another may be problematic in some installations.

The inventors have observed an unexpected result in that the helical ribs 212 exhibit a tendency to back out of the helical grooves 262 when rotated in reverse. In other words, the helical ribs 212 are prone to moving longitudinally in the helical grooves 262 in a manner that the helical ribs 212, if not impeded, would axially withdrawal from the helical grooves 262 and realize separation of the couplers 200, 250 when the coupler assembly is subject to reverse rotation. The spring retainer element 270 operates to inhibit such withdrawal and associated separation of the couplers 200, 250 and instead maintain the ribs 212 fully engaged in the grooves 262. But this imposes an undesirable stress on the spring retainer element 270 that can compromise the connection between the couplers 200, 250 as reverse rotational force (i.e., torque) increases. In certain cases, torsional forces can rise to levels wherein the spring element 270 experiences shear stress to the point of failure, leaving the couplers 200, 250 effectively uncoupled in the axial direction. If uplift forces are also present in this state, the couplers 200, 250 can undesirably separate from one another in a manner that would defeat the integrity of the foundation support system. Considering that this may happen at a below ground location that may be difficult to detect, the building foundation may not be adequately supported despite the presence of the foundation support system.

Additionally, and apart from any reverse rotation that tends to withdraw the helical ribs 212 from the helical grooves 262 and separate the couplers 200, 252, similar dynamics can result when the coupler assembly is subjected to uplift forces that tend to pull the couplers 200, 250 apart. Initially the spring element 270 will operate to oppose the uplift forces and maintain engagement of the ribs 212 and grooves 260, but if uplift forces are sufficiently high, stress imposed on the spring element 270 may cause it to shear and effectively uncouple the couplers with potential to defeat the integrity of the foundation support system.

FIGS. 4-7 are various views of a coupled shaft assembly 300 for the foundation support system 100 shown in FIG. 1 in accordance with an exemplary embodiment of the present invention that beneficially overcomes the limitations of the snap-lock coupler system shown in FIGS. 2 and 3. Method aspects of the inventive couplers will be in part apparent and in part explicitly discussed in the following description.

The coupler assembly 300 in the example shown includes a first or outer coupler 302 provided on a first shaft 304 which may be an extension pile in a foundation support system such as that shown in FIG. 1. The coupler assembly 300 also includes a second or inner coupler 306 provided on a second shaft 308 which may be a primary pile in a foundation support system such as that shown in FIG. 1. Alternatively the shafts 304, 308 may each be extension piles in a foundation support system. It is recognized, however, the that shafts 304, 308 need not be primary or extension foundation support pile elements at all, and instead the couplers 302, 306 may be used in a wide variety of pipe or shaft systems that present similar problems and concerns to those discussed above or that may benefit from the coupling features described herein in another end use or application besides a foundation support system.

The couplers 302, 306 including the features illustrated and described further below may be separately manufactured from the shafts 304, 308 in certain embodiments, and thereafter attached to each shaft 304, 308 in a known manner, including but not necessarily limited to welding. Alternatively, the couplers 302, 306 may be integrally formed on respective ends of the shafts 304, 308 via casting, forging and swaging processes instead of separately provided and attached elements. The couplers 302, 306 and the shafts 304, 308 may each be fabricated from high strength steel or another suitable material according to known techniques.

The shafts 304, 308 connected through the couplers 302, 306 can be hollow or filled with a substance such as concrete, chemical grout, or another known suitable cementitious material or substance familiar to those in the art to enhance the structural strength and capacity of the shafts when used as foundation support pilings or in other end use applications. The pilings defined by the connected shafts 304, 308 may be prefilled with cementitious material in certain contemplated embodiments.

Likewise, in other contemplated embodiments, cementitious material, including but not necessarily limited to grout material familiar to those in the art, may be mixed into the soil around the piles as they are being driven into the ground, creating a column of cementitious material around the pilings for further structural strength and capacity to support a building foundation. Grout and cementitious material may be pumped through the hollow pilings under pressure as the pilings are advanced into the ground, causing the hollow pilings to fill with grout, some of which is released exterior to the pilings to mix with the soil at the installation site. Openings and the like can be formed in the piles to direct a flow of cementitious material through the piles and at selected locations into the surrounding soil.

Figure 4:
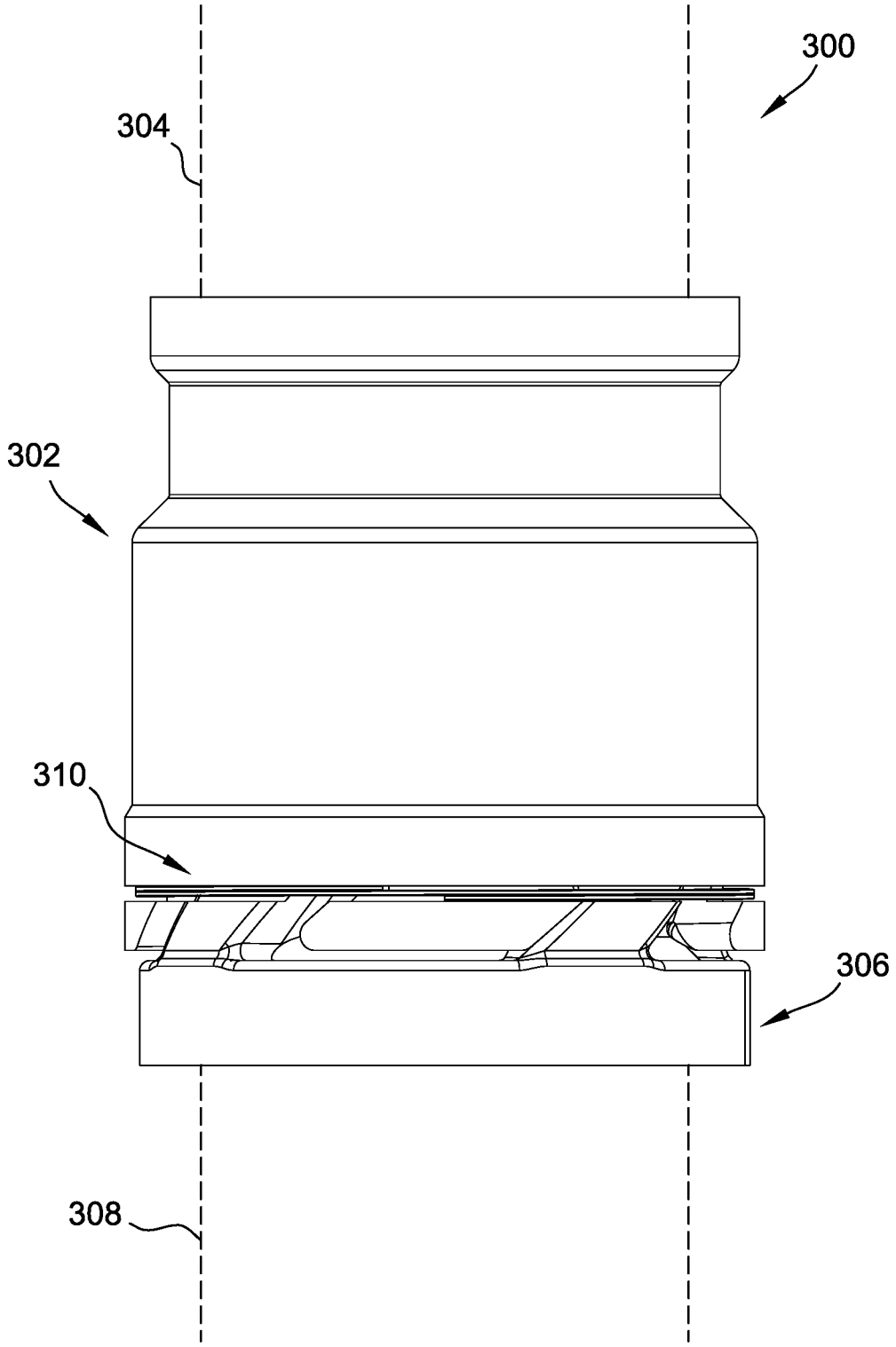
FIG. 4 is a front elevational view of a snap-lock coupler assembly for the foundation support system shown in FIG. 1 in accordance with an exemplary embodiment of the present invention.
Figure 5:
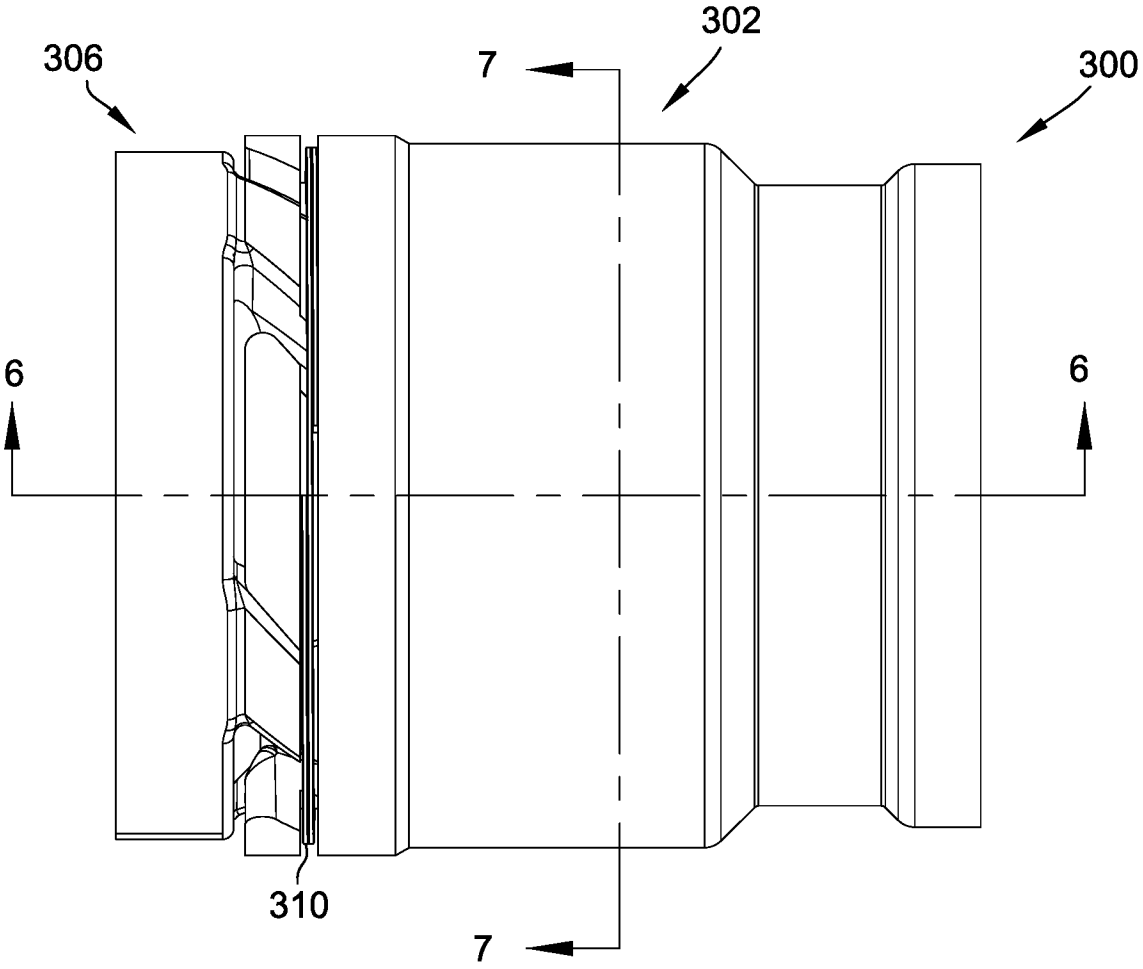
FIG. 5 is a side view of the snap-lock coupler assembly shown in FIG. 4.

Like the couplers 200, 250 shown in FIGS. 2 and 3, a spring retainer element 310 is provided to automatically interlock the couplers 302, 306 with a desired snap-action. Also like the couplers 200, 250 shown in FIGS. 2 and 3, the spring element 310 is enlarged in diameter as the couplers 302, 306 are engaged, and resiliently snaps back to its original diameter in a state occupying circumferential retaining grooves in each of the couplers 302, 306 as shown in FIGS. 4 and 5.

Figure 14:
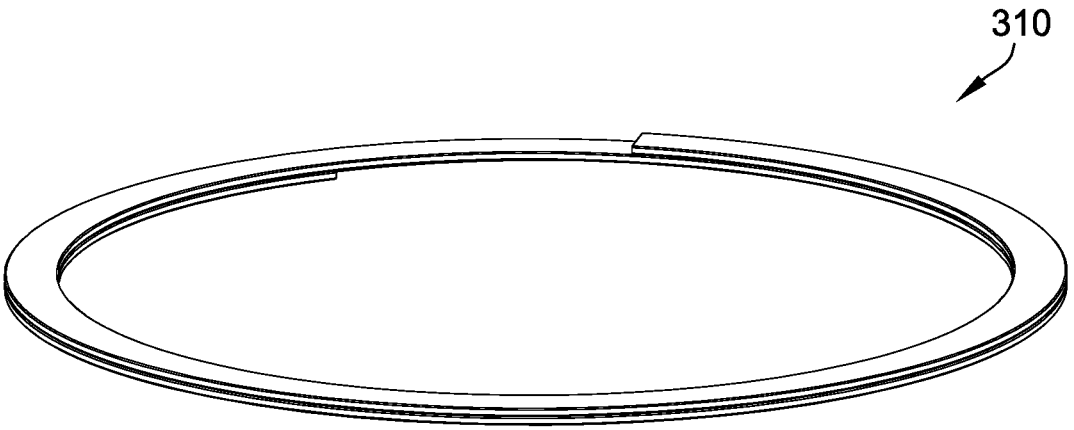
FIG. 14 is a perspective view of an exemplary spring element for the snap-lock coupler assembly shown in FIGS. 4 and 5.
Figure 15:
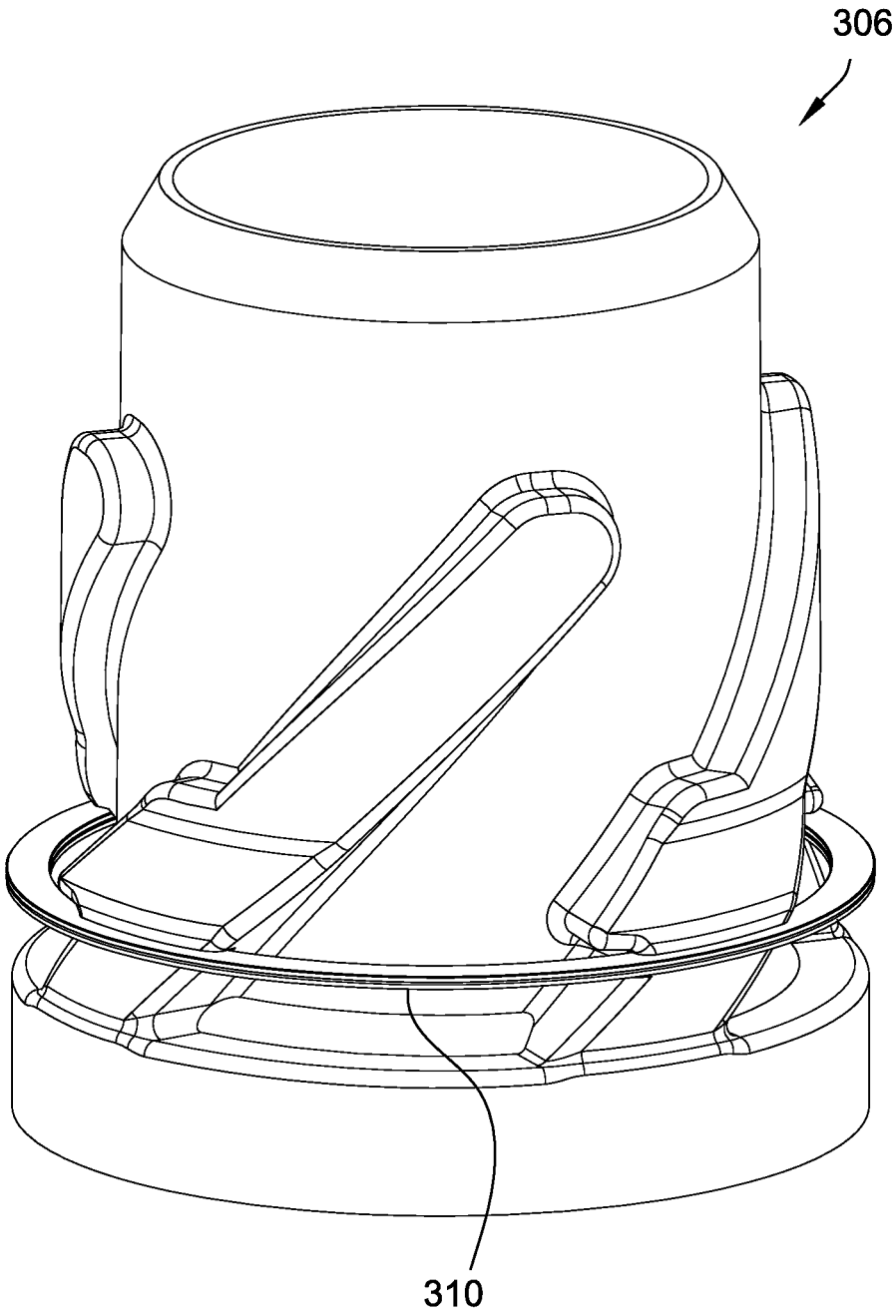
FIG. 15 is a perspective view of the inner coupler shown in FIG. 8 with the spring element shown in FIG. 14.
Figure 16:
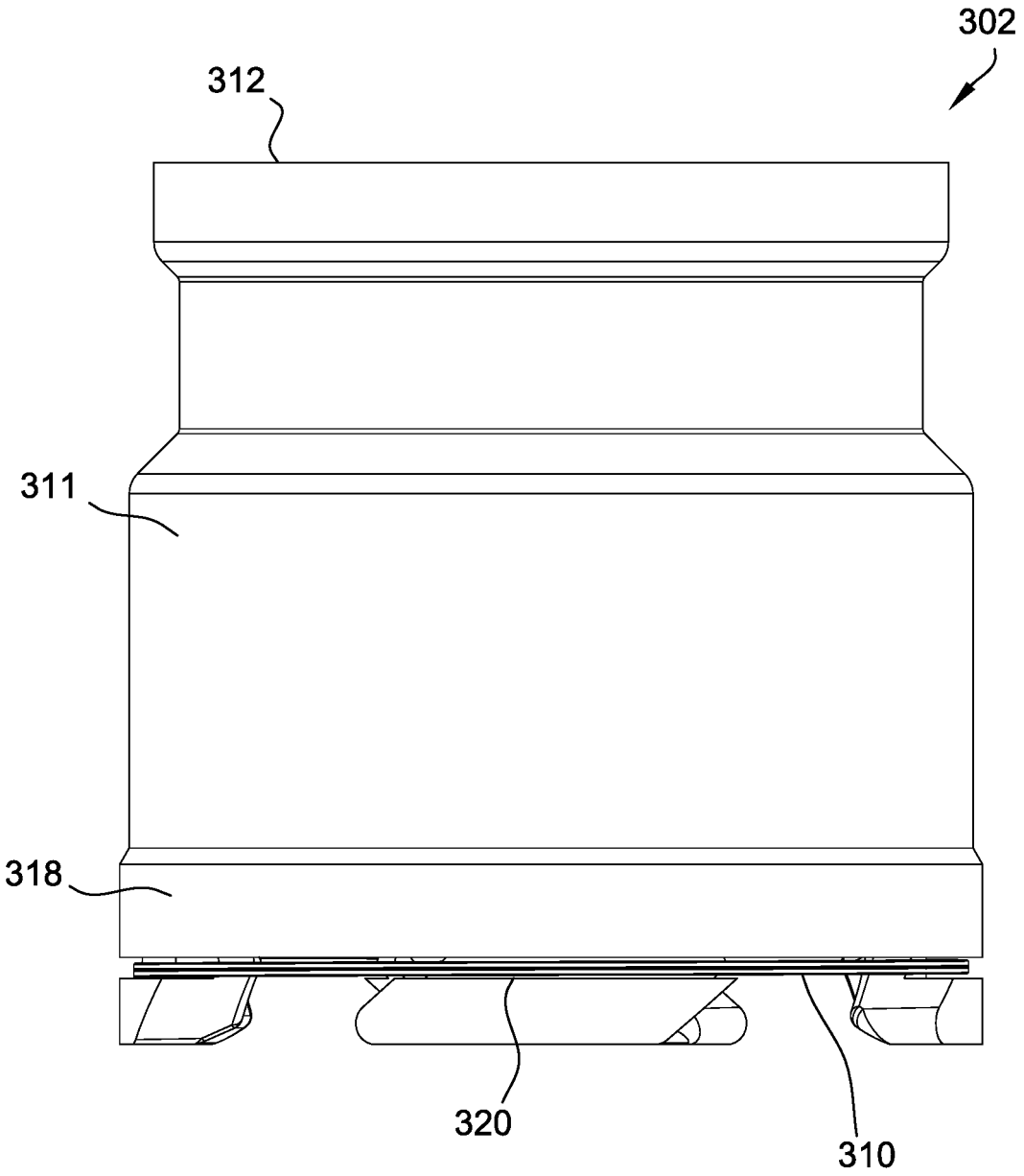
FIG. 16 is a side elevational view of the outer coupler shown in FIG. 12 with the spring element shown in FIG. 14.

As shown in FIGS. 14-16, and unlike the annular spring 270 of the couplers 200, 250 that is generally planar and shaped to extend around the circumference of the coupler ends for less than 360° as described in U.S. Patent Application Publication No. 2021/0254298, the spring element 310 extends in the circumferential grooves of the couplers 302, 306 well beyond 360° around the circumference of the couplers. In the illustrated example, the spring element 310 extends in a spiral arrangement that from end-to-end completes a bit less than three full 360° turns around the circumference of the couplers 302, 306. Of course, a multi-turn spring element 310 having greater or fewer than about three full 360° turns may be utilized in alternative embodiments with similar effect. The spring element 310 has a rectangular cross section and a low profile in the height dimension to fit within the associated grooves in the couplers 302, 306 in a compact arrangement as shown in FIGS. 15 and 16.

In contemplated embodiments, the spring element 310 is fabricated from a resiliently deflectable metal material, metal alloy or another suitable material allowing the spring retainer element 310 to elastically expand in the radial dimension from an initial diameter to a larger diameter when subjected to an outwardly directed force, and return to its initial diameter when the outwardly directed radial force is removed.

Relative to a fractional turn spring element like the annular spring element 270 (i.e., a spring element that completes less than one full 360° turn in the circumferential grooves of the couplers 302, 306), such a multi-turn spring element 310 provides additional structural strength and spring force for the desired snap-action engagement in the foundation support application whiles still beneficially avoiding any use of separately provided fasteners such as bolts to complete the desired interconnections of shafts 304, 308. In the context of the present description, the increased structural strength of the multi-turn spring element 310 makes it accordingly less prone to problematic shearing than the annular, planar element 270 of the couplers 200, 250 when the couplers 302, 306 are subjected to reverse rotation and/or uplift forces in use. Additional structure, however, is beneficially provided in the couplers 302, 306 providing only a predetermined degree of relative reverse rotation of the couplers 302, 306 and an independent axial interlock coupling apart from the spring element 310 when needed. By virtue of such additional structure, the couplers 302, 306 therefore reduce, if not eliminate, any chance that the spring element 310 could mechanically fail at an underground location to due to mechanical shear stress or overload associated with reverse rotation and/or uplift forces.

Specifically, and as further described below, anti-reverse rotation features are built-in to the rib and groove design of the couplers 302, 306 that ensure that a problematic relative rotation and separation of the couplers 302, 306 will not occur if the shaft 304, for example, is subjected to reverse rotation in the installation of a foundation support system and/or is subjected to uplift forces in use. In the coupler assembly 300, and by virtue of the built-in anti-reverse rotation features in the ribs and grooves, rotational and uplift forces are borne between mating ribs and grooves formed in the couplers 302, 306 as further described below. Separately provided anti-reverse rotation elements, including but not limited to fasteners such as bolts, are therefore desirably avoided by the built-in anti-reverse rotation features of the couplers 302, 306, and no action is needed by an installer to address reverse rotation issues with separately provided elements in the installation of a foundation support system.

As seen in FIGS. 5-7, 11-13 and 16, the outer coupler 302 includes a hollow main body 311 and a shaft receiving end 312. The main body 311 includes an inner surface 314 having a first set or first series of spaced apart grooves 316 depending inwardly therefrom. The main body 311 further includes an outer surface 318 defining a second set or series of retaining grooves 320 for the spring element 310. In the illustrated example, the main body 311 is cylindrically shaped with a round, circular cross section having a uniform or constant inner and outer diameter along an axial centerline of the main body in the coupler 302. In an alternative embodiment, however, the main body 311 may have a tapered inner and outer diameter such that the inner and outer diameter may change (e.g., may increase) along an axial centerline of the main body.

The spring element 310 is pre-installed and permanently attached to the coupler 302 (i.e., the spring retainer element 310 is not intended to be removed) via the grooves 320 and is therefore integrated into the coupler design in contemplated embodiments as shown in FIG. 16. This allows the coupler 302 to be provided to the installer with the spring retainer element 310 already in place, eliminating any need for an installer to locate a spring element. By virtue of the spring element 310, a separately provided fastener (or fasteners) including but not necessarily limited to conventional bolts to attach piles to one another in conventional foundation support systems is not required. Associated installation steps of installing separately provided fasteners (e.g., bolts) are eliminated and installation time and labor costs associated with such installation steps are desirably eliminated.

Figure 6:
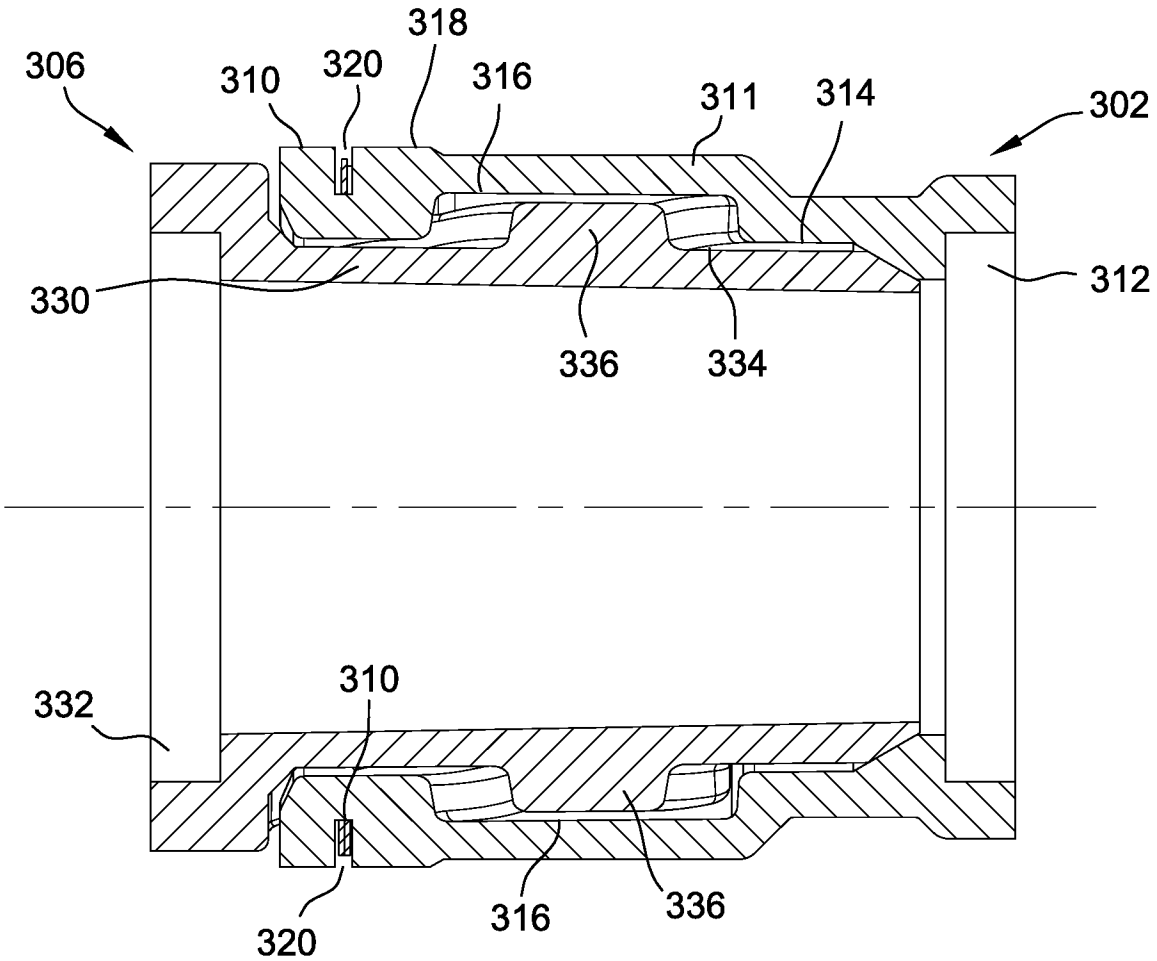
FIG. 6 is a first sectional view of the snap-lock coupler assembly taken along line 6-6 in FIG. 5.
Figure 7:
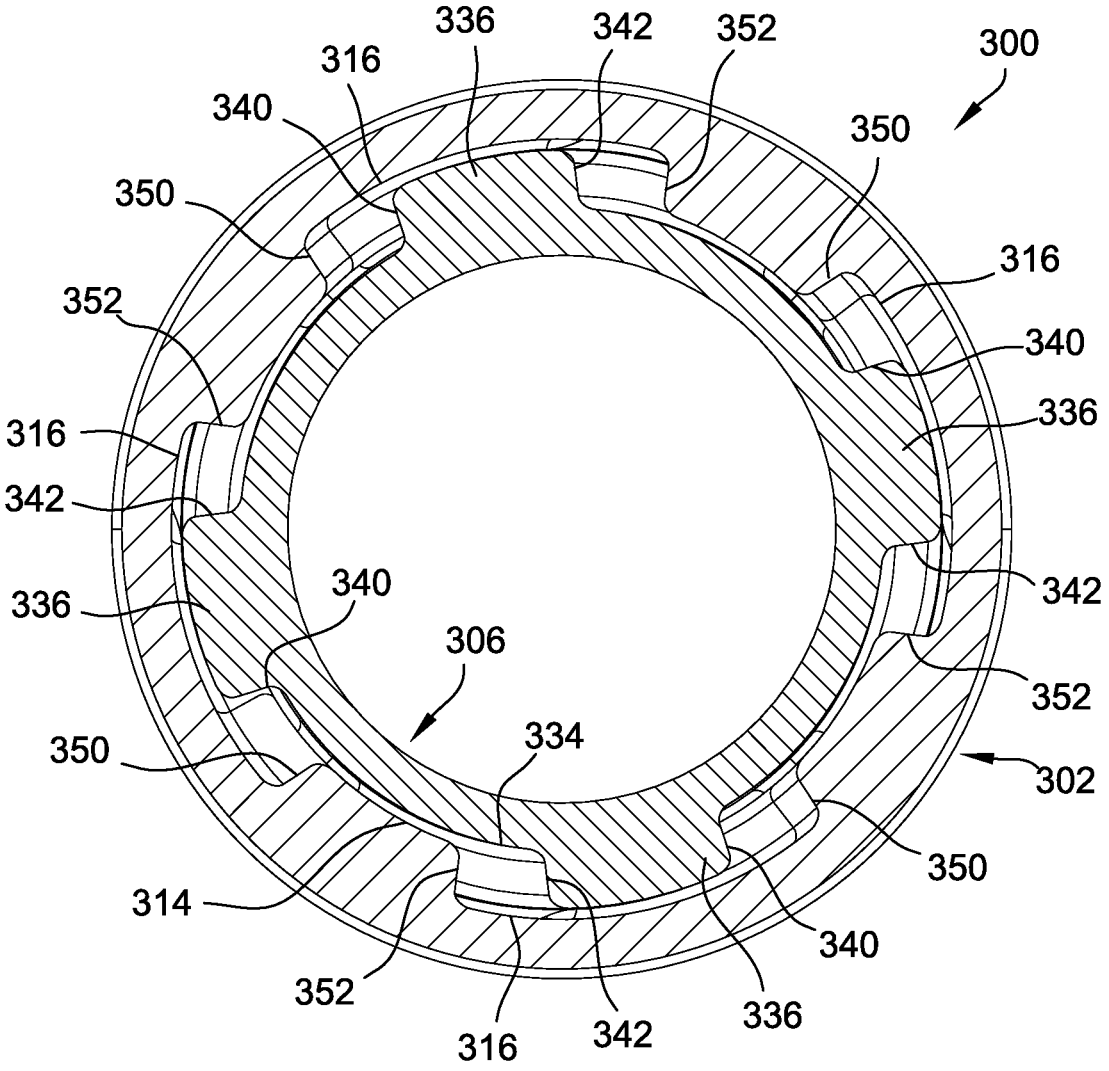
FIG. 7 is a second sectional view of the snap-lock coupler assembly taken along line 7-7 in FIG. 5.
Figure 8:
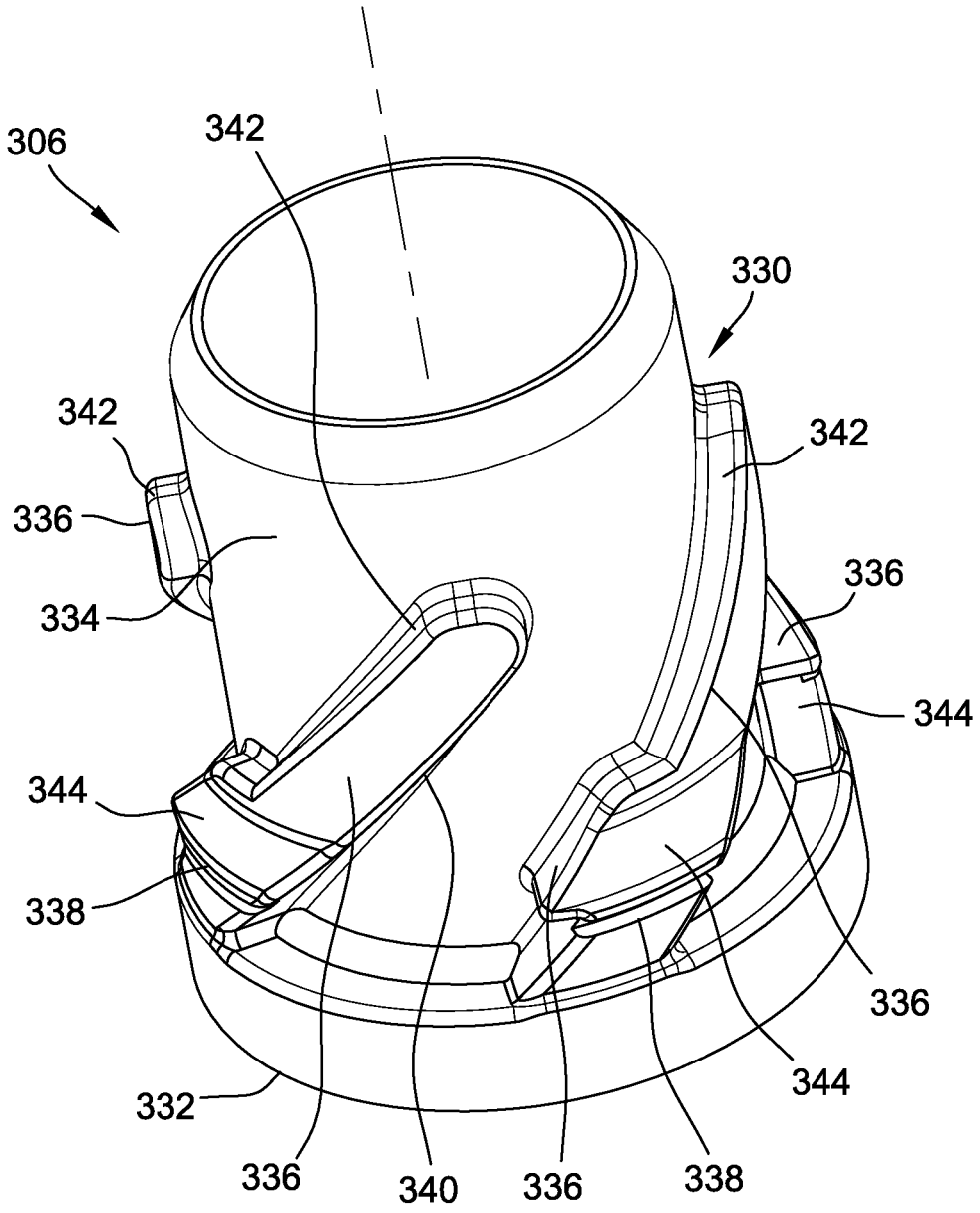
FIG. 8 is a perspective view of an exemplary embodiment of an inner coupler for the coupler assembly shown in FIGS. 4 and 5.
Figure 9:
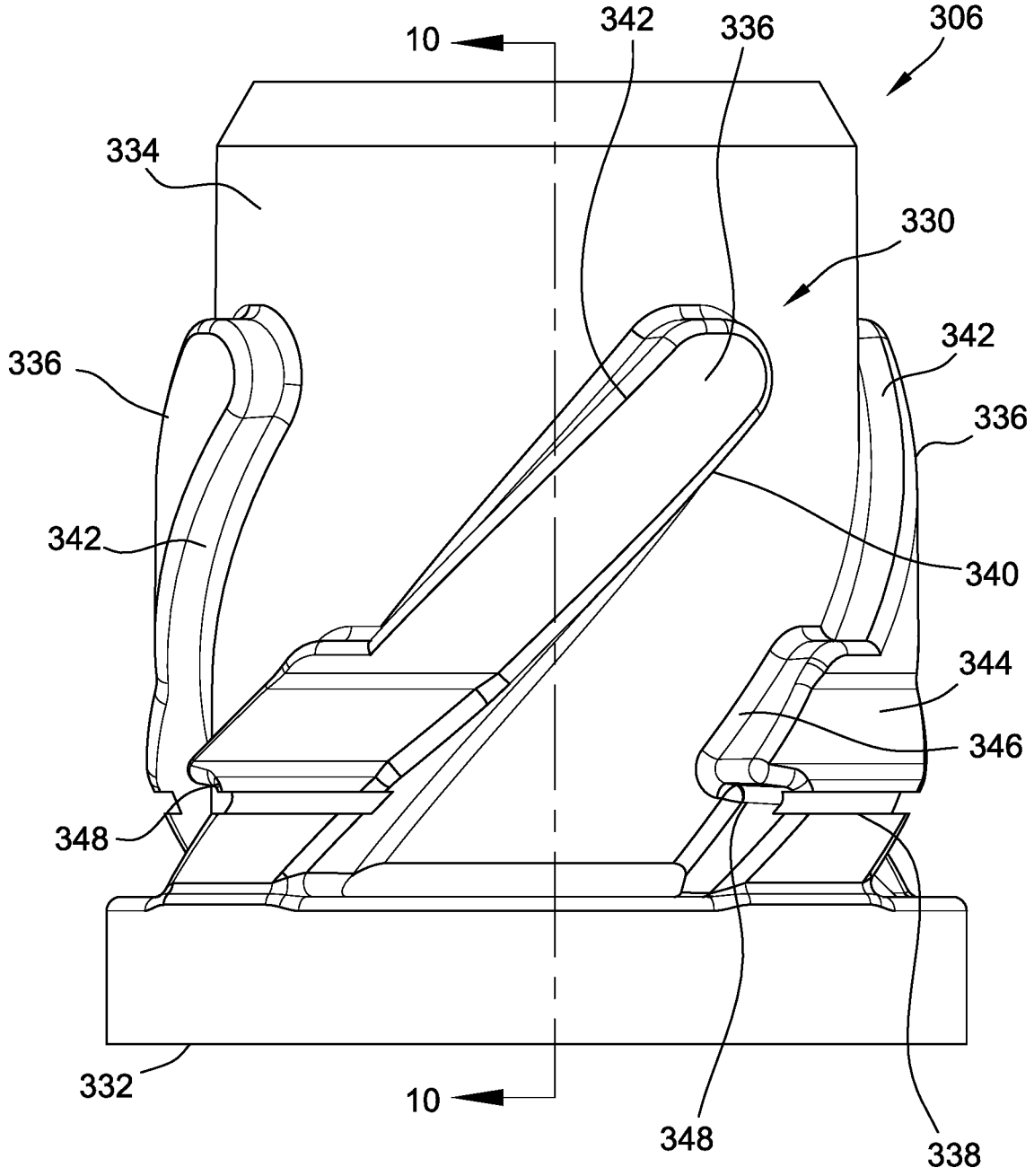
FIG. 9 is a side elevational view of the inner coupler shown in FIG. 8.
Figure 10:
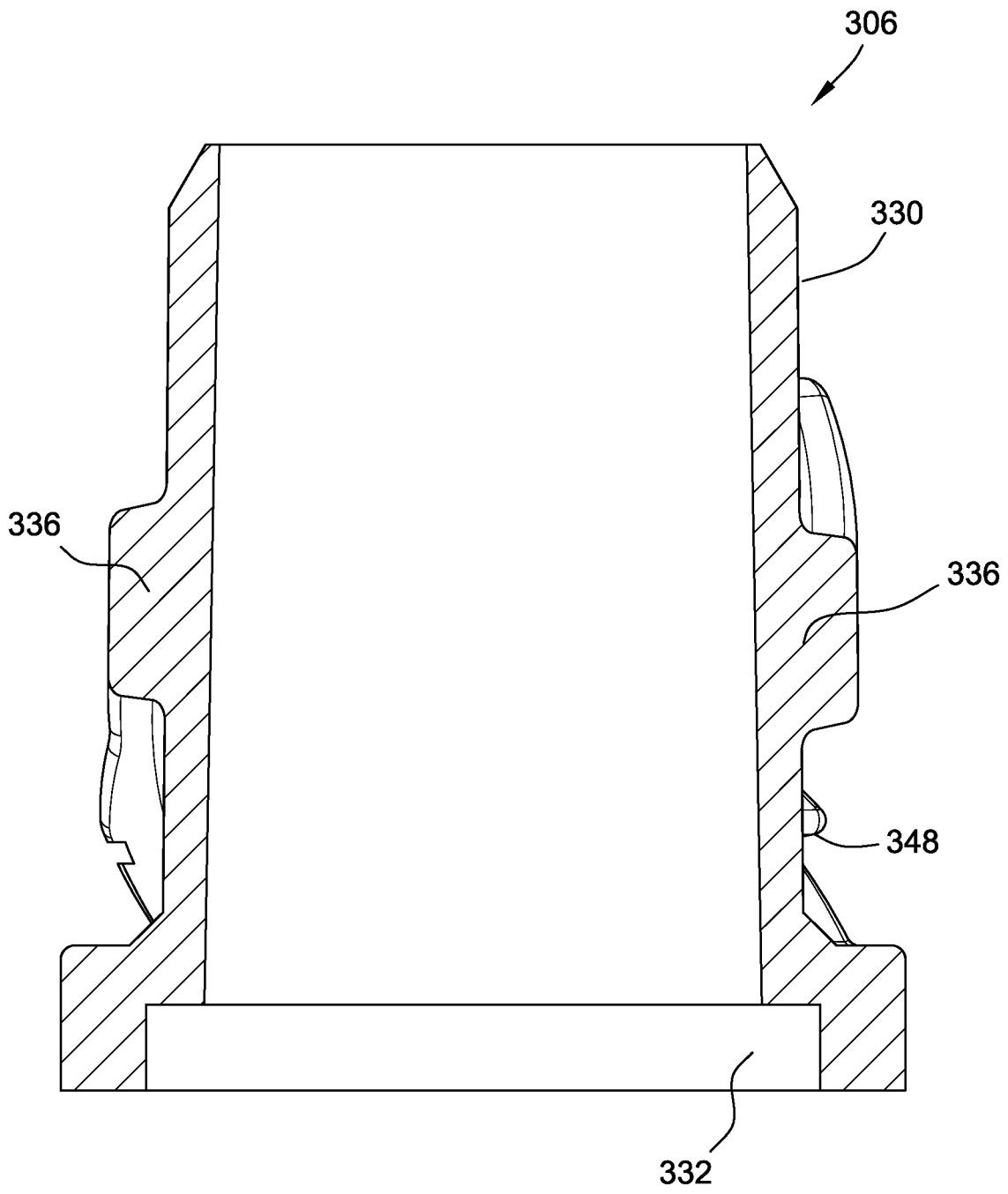
FIG. 10 is a sectional view of the inner coupler taken along line 10-10 in FIG. 9.

As seen FIGS. 5-7 and also the views of FIGS. 8-10, the inner coupler 306 includes a hollow main body 330 and a shaft receiving end 332 in the illustrated example. The main body 330 also includes an outer surface 334 having a series of spaced apart ribs 336 projecting outwardly therefrom. Each rib 336 also includes an outer surface defining a retaining groove 338 for the spring element 310 as shown in FIG. 15. Once the couplers 302, 306 are engaged, the spring element 310 resides in part in the retaining grooves 338 of the coupler 306 and in part in the aligned retaining grooves 320 of the coupler 302 as shown in FIGS. 4 and 5.

In the illustrated example, the main body 330 is cylindrically shaped with a round, circular cross section having a uniform or constant inner and outer diameter along an axial centerline of the main body in the coupler 306. In an alternative embodiment, however, the main body 330 may have a tapered inner and outer diameter such that the inner and outer diameter may change (e.g., may decrease) along an axial centerline of the main body.

Referring to FIGS. 6 through 9, the main body 330 of the inner coupler 306 is formed with a number of distinct, outwardly projecting spaced apart and helically extending ribs 336 projecting from outer surface 334. In the example shown, four helical ribs 336 are provided that are spaced about 90° apart from one another on the circumference of the main body 330. The helical ribs 330 each extend spirally upon the outer surface 334 of the main body 330 with a relatively large pitch (i.e., the end-to-end vertical rise of the helical ribs in FIG. 9 is large compared to the horizontal run of the helical ribs along the helical path defined in the ribs). In the illustrated example, the pitch of the helical ribs 336 is such that, from the base of the pile receiving end 332 to the distal end of each rib 336, less than one complete turn of a helix is completed. For the context of the present description, a complete turn of a helix shall refer to a full 360° revolution on the circumference of the main body 330. As such, and in the exemplary coupler shown, each rib 336 completes a fractional turn (i.e., less than one turn or less than a 360° revolution) of a helix on the main body 330.

In the illustrated example, each rib 336 completes about a quarter turn (i.e., ¼ turn) of a helix on the main body 330, although more or less than about ¼ turn is possible in alternative embodiments. The distinct, helical ribs 336 extend as thread-like members on the outer surface of the main body 330, but are specifically distinguished from a more conventional threaded connection including small pitch helical threads that continuously define multiple turns of a helix. While a specific geometry and a specific number of helical ribs 336 is shown and described, it is appreciated that alternative numbers of ribs 336 and/or alternative geometries of ribs 336 is possible in another embodiment.

In the example shown, each rib 336 includes a first longitudinal side edge 340 and a second longitudinal side edge 342 opposing the first side edge 340. The first side longitudinal side edge 340 is uniformly curved without any discontinuity, while the second longitudinal side edge 342 includes a discontinuous laterally extending projection. Such laterally extending projection on the longitudinal side edge 342, but not the longitudinal side edge 340, imparts an asymmetry to each rib 336. The laterally extending projection defines an anti-reverse rotation section 344 having an increased lateral thickness than the remainder of each rib 336. The anti-reverse rotation section 344 extends proximate to but is spaced from the retaining grooves 338 defined in each rib 336. The anti-reverse rotation section 344 overhangs the retaining groove 338 on the longitudinal side edge 342. The overhanging anti-reverse rotation section 344, in turn defines an anti-reverse rotation stop surface 346 and an uplift bearing surface 348. The anti-reverse rotation stop surface 346 in the example shown extends along a helical path that is laterally offset from the remainder of the helical path of the second longitudinal side edge 342, while the uplift bearing surface 348 extends perpendicularly to the longitudinal axial centerline of the coupler 306. In the illustration of FIG. 9, the longitudinal axial centerline of the coupler 306 extends vertically while the uplift bearing surface 348 extends horizontally in each rib 336. The uplift bearing surfaces 348 extend planar to one another in the horizontal direction.

Since four ribs 336 are provided in the coupler 306, four overhanging anti-reverse rotation sections 344 are provided (one in each rib 336) that are distributed about the circumference of the coupler 306, four anti-reverse rotation stop surfaces 346 are provided (one in each overhanging anti-reverse rotation section 344) that are distributed about the circumference of the coupler 306, and four uplift bearing surfaces 348 are provided (one in each overhanging anti-reverse rotation section 344) that are distributed about the circumference of the coupler 306. The anti-reverse rotation stop surfaces 346 and uplift bearing surfaces 348 engage complementary features in the coupler 302 to prevent relative rotation of the couplers in the reverse direction beyond a predetermined amount or degree and thereafter to maintain a full, rotational interlock of the couplers 302, 306 in the reverse rotational direction, while simultaneously realizing an axial interlock of the couplers 302, 306 via the uplift bearing surfaces in each coupler. As shown in the Figures, the overhanging section 344, the anti-reverse rotation stop surfaces 346, and the uplift bearing surfaces 348 in each rib 336 is integrally formed and built-in to the coupler design, and may be formed via known manufacturing processes such as, for example, casting, forging and swaging, and machining processes in combination with the remaining features of the coupler 306.

Referring to FIGS. 4-7 and 11-13, helical grooves 316 are formed to depend from the inner surface 314 of the main body 311 in the coupler 302. Each helical groove 316 receives a respective one of the helical ribs 336 (FIGS. 8-10) when the coupler 302 is mated with the coupler 306 (FIGS. 4-7). The helical grooves 316 are shaped in a complementary manner to the helical ribs 336 but are larger than the helical ribs so as to permit a limited degree of rotational, side-to-side movement of the ribs 336 in the grooves 316. As such, a rotational, side-to-side movement of the ribs 336 in the grooves 316 is intended as the couplers are installed but only to a certain extent in order to prevent an over-rotation of the couplers that could overload or overstress the spring element 310 and compromise the axial connection between the couplers. Specifically, and referring to FIGS. 6, 7, 11 and 13 each groove 316 includes a first longitudinal side edge 350 and a second longitudinal side edge 352. As best shown in FIGS. 6 and 7, the longitudinal side edges 350, 352 are spaced apart by a first circumferential distance that about twice as much than the circumferential spacing of the longitudinal side edges 340, 342 of the ribs 336 in the coupler 306. That is, and in the position shown in FIG. 7, the side edges of the grooves 316 in the coupler 302 are oversized relative to the side edges of the ribs 336 in the coupler 306, and such oversizing means that the side edges of ribs 336 are gapped from each of the side edges of the grooves 316. The ribs 336 may therefore be moved relative to the grooves 316 (or vice versa) before engaging a rotationally interlocked position between the couplers 302, 306. As such, the couplers 302, 306 may be rotated relative to one another within a predetermined limit defined by the gap length in both forward and reverse directions. Such a predetermined, limited degree of side-to-side movement of the ribs 316 within the gaps may be increased or decreased in various embodiments to provide more or less relative rotation of the couplers before becoming positively engaged in the forward or reverse direction of rotation as further described below.

Figure 11:
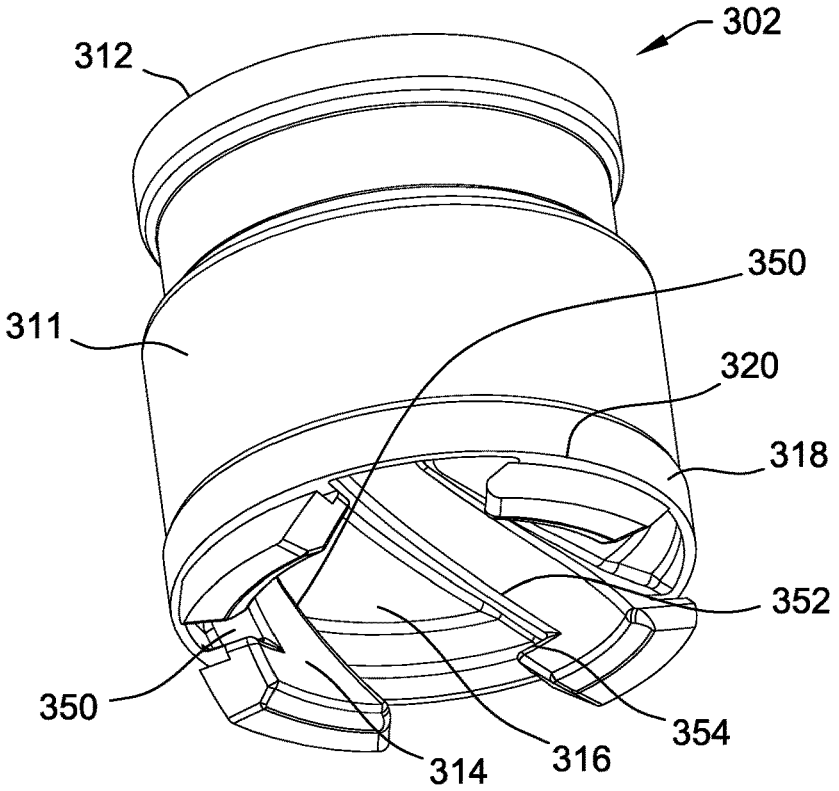
FIG. 11 is a perspective view of an exemplary embodiment of an outer coupler for the coupler assembly shown in FIGS. 4 and 5.
Figure 12:
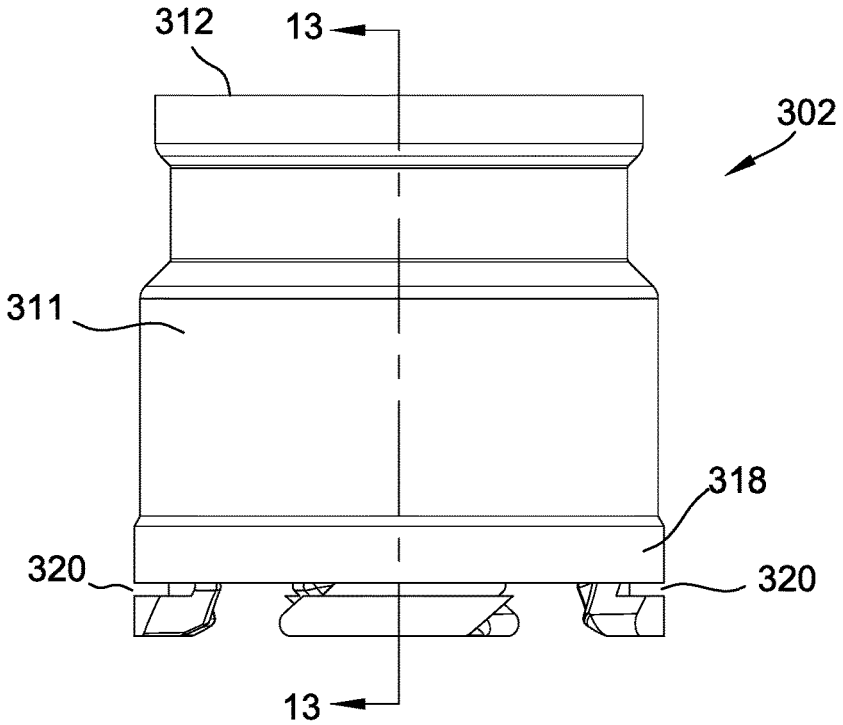
FIG. 12 is a side elevational view of the outer coupler shown in FIG. 11.
Figure 13:
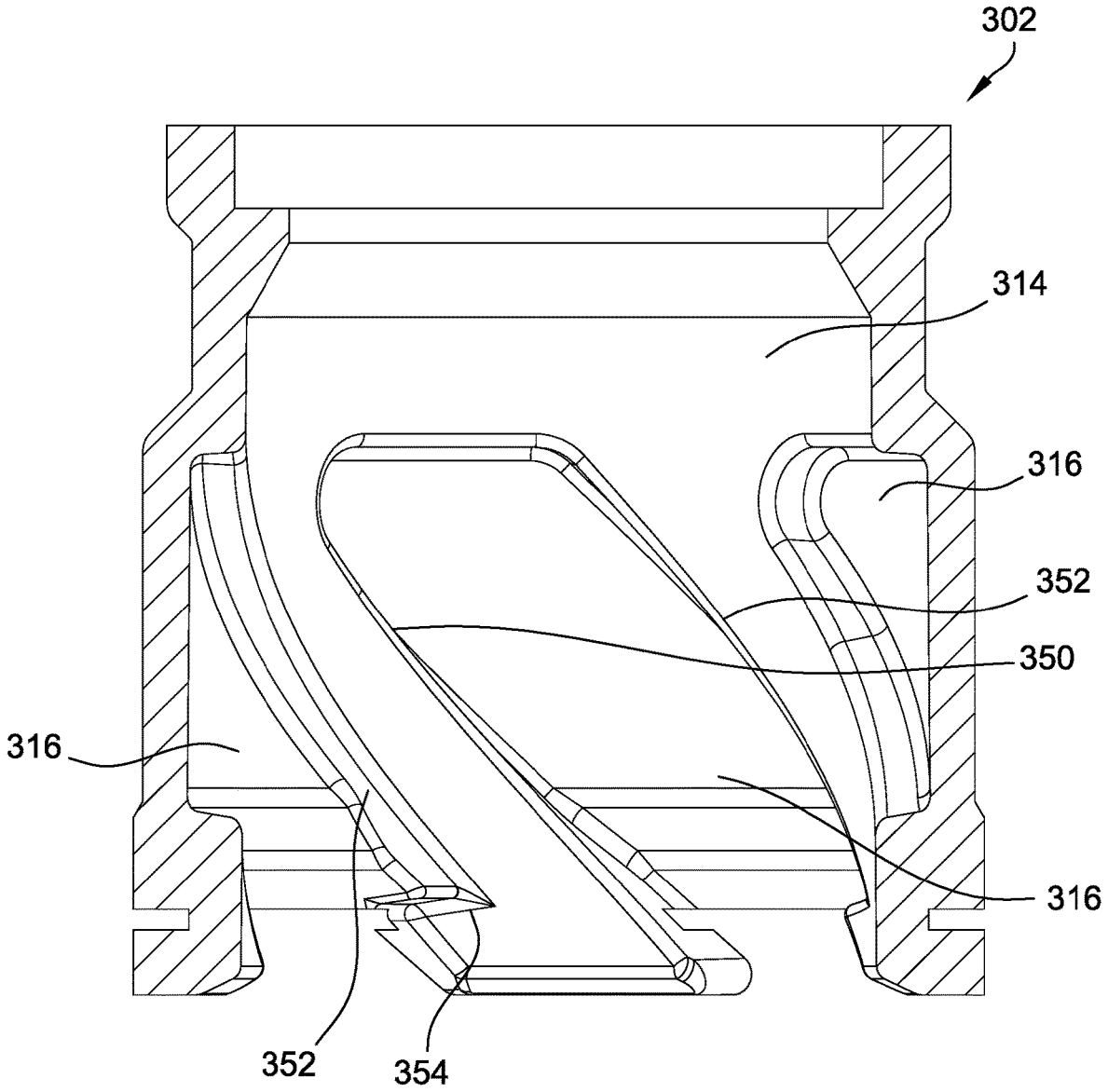
FIG. 13 is a sectional view of the outer coupler shown in FIGS. 11 and 12.

As shown in FIGS. 11 and 13, the first longitudinal side edge 350 of each groove 316 is uniformly curved without any discontinuity, while the second longitudinal side edge 352 includes a discontinuous laterally extending projection. Such laterally extending projection on the longitudinal side edge 352, but not the longitudinal side edge 350, imparts an asymmetry to each groove 316. The laterally extending projection defines an anti-reverse rotation section 354 proximate a distal end of the coupler 302. The anti-reverse rotation section 354 extends proximate to but is spaced from the exterior retaining grooves 320 defined in the outer circumference of the coupler 302.

Since four ribs 336 are provided in the coupler 306, four grooves 316 are provided in the coupler 302 that are distributed about the circumference of the coupler 306. As shown in the Figures, the anti-reverse rotation section 354 is integrally formed and built-in to the coupler design, and may be formed via known manufacturing processes such as, for example, casting, forging and swaging, and machining processes in combination with the remaining features of the coupler 306.

The anti-reverse rotation section 354 constricts the groove 316 in the lateral direction, and when coupler 302 is rotated in a reverse rotational direction (e.g., clockwise in FIGS. 7 and 8) the anti-reverse rotation section 354 of the respective grooves 316 receives the anti-reverse rotation sections 344 of the ribs 336. Once the anti-reverse rotation sections 344 of the ribs 336 are so received, the anti-reverse rotation stop surface 346 of the anti-reverse rotation sections 344 engage the longitudinal side walls 352 of the grooves 316. Such engagement provides a positive stop to relative rotation of the couplers 302, 306 and the couplers 302, 306 will thereafter be rotationally interlocked if subjected to continued reverse rotation. The uplift bearing surfaces 348 of the anti-reverse rotation sections 344 also respectively seat upon the surface of the anti-reverse rotation section 354 when the anti-reverse rotation sections 344 of the ribs 336 are received by the anti-reverse rotation section 354 in the respective grooves 316, establishing a positive axial interlock between the couplers if subjected to uplift forces. The spring element 310 is therefore mechanically isolated from undesirable mechanical loading associated with reverse rotation and uplift forces, preventing shear stress and possible failure of the spring element 310 that could otherwise occur.

Likewise, when the coupler 302 is rotated in a forward rotational direction (e.g., counter-clockwise in FIGS. 7 and 8) the anti-reverse rotation sections 354 of the respective grooves 316 are disengaged from the anti-reverse rotation sections 344 of the ribs 336, and the side edges 340 of the ribs 336 engage the side edges 350 of the grooves 316. Such engagement provides a positive stop to relative rotation of the couplers 302, 306 and the couplers 302, 306 will thereafter be rotationally interlocked if subjected to continued forward rotation. Axial forces are also effectively distributed between the helical ribs 336 and the grooves 316, establishing a positive axial interlock between the couplers when driven in the forward direction.

The grooves 316 in the coupler 302 may be freely rotated relative to the ribs 336 in the coupler 306 (or vice versa) in forward and reverse directions to establish the forward and reverse rotational interlock positions described, without impacting the spring element 310 and while ensuring that the couplers 302, 306 cannot be inadvertently disengaged at a below ground location during installation processes in a foundation support system application.

In use, and referring back to FIG. 4, the shaft 308 which may be a helical foundation support pile is driven into the ground to a desired depth in a known manner with the coupler 306 attached. The coupler 302 that is attached to the shaft 304, which may be an extension pile, is therefore inserted over the exposed coupler 306 and the ribs 336 are received in the grooves 316 in a generally self-aligning manner to one another for convenience of the installers. The spring element 310 is enlarged in diameter and then automatically snaps into-place to axially interconnect the couplers 302, 306 when the spring retaining grooves 320 and 338 are aligned with one another. Separately fabricated fastener elements such as bolts, and additional manually performed steps associated with installing such fastener elements, are not needed to securely engage the couplers, and as a result a considerably faster coupling of shafts is possible. Snap-action engagement is simply accomplished via the self-alignment of the couplers 302, 306 and gravitational forces acting upon the spring retainer element 310 until the alignment of the retaining grooves 320 and 338 is obtained, allowing the spring retainer element 270 to automatically engage and snaps into place without the installer having to take any further action to complete the connection.

Once the couplers 302, 306 are engaged, the shaft 304 can be rotated in the forward direction to drive the interconnected shafts 304 and 308 into the ground. More than one coupler assembly 300 may be provided to interconnect another extension pile as needed. If reverse rotation of any shaft is needed during the installation, the anti-reverse rotation features described will allow a small, predetermined degree of rotation of the coupler 302 relative to the coupler 306 and thereafter preclude further relative rotation, ensuring that the couplers cannot be separated and also ensuring that the spring retainer element 270 is not overstressed. Completion of a foundation support assembly may include attachment of a support plate, support bracket, lifting assembly, etc. to support the foundation in the desired manner at the top of the pile adjacent the foundation.

If for any reason the couplers 302, 306 may be desirably uncoupled after assembly, the spring element 310 may be easily accessed from the exterior of the coupler assembly, and when the spring element 310 is pried upon by manually enlarging its diameter with a tool or tools, for example, the coupler 306 may be disengaged from the coupler 302 and the couplers may therefore be separated.

While one exemplary implementation of the couplers 302, 306 are described, variations are of course possible while still realizing similar benefits and advantages. For example, while FIG. 4 shows the coupler 306 on the lower shaft 308 and the coupler 302 on the upper shaft 304, the coupler 302 could instead be provided on the lower shaft 308 while the coupler 306 could be provided on the upper shaft 304 without impacting the functional benefits and advantages of the engaged couplers 302, 306 described above.

In another contemplated variation to the assembly 300 described above, the orientation of ribs and grooves in the couplers 302, 306 could be reversed in another variation of the invention. As such, the ribs 336 could be provided on the inner surface of the coupler 302, while the grooves 316 could be provided on the outer surface of the coupler 306 to realize the same functional benefits and advantages to those described above. Likewise, combinations of ribs and grooves in each coupler 302, 306 are possible while realizing the same benefits and advantages.

In another contemplated variation to the assembly 300 described above, the anti-reverse rotation sections 354 of the respective grooves 316 and the anti-reverse rotation sections 344 of the ribs 336 as described above may be implemented in couplers having ribs and grooves that are not helical to provide beneficial, limited degrees of relative rotation of the couplers in reverse and/or to ensure that uplift forces will not overstress the spring element 270 or 310 in the snap-lock coupler assembly.

In another contemplated variation to the assembly 300 described above, combinations of the variations described above could be implemented in the assembly without affecting the resultant benefits and advantages of the invention.

It should be appreciated that the couplers 302, 306 described may be more or less universally used to connect shafts of different size and circumference as well as different cross-sectional shapes. For example, the couplers described above may be used to rotationally interlock shafts have round or circular cross-sectional shapes, square or rectangular cross-sectional shapes, or hexagonal cross-sectional shapes as non-limiting examples. The couplers may also be utilized to interconnect shafts having different size and circumferential dimensions and/or shafts having different cross-sectional shapes as desired or as needed.

The benefits and advantages of the inventive concepts described herein are now believed to have been amply illustrated in relation to the exemplary embodiments disclosed.

A foundation support system has been disclosed including a coupled shaft assembly. The coupled shaft assembly includes an inner coupler extending on a first end of a first hollow foundation support shaft and an outer coupler extending on a second end of a second hollow foundation support shaft. The inner coupler is formed with a first main body and at least one of a rib or a groove in the first main body. The outer coupler is formed with a second main body and at least one of a rib or a groove in the second main body. The coupled shaft assembly further includes a spring retainer element automatically establishing an axial, snap-lock connection between the inner coupler and the outer coupler when the inner coupler is received in the outer coupler and when the rib is located in the groove to establish a torque transmitting connection between the inner coupler and the outer coupler. The rib or groove includes a first longitudinal side edge and a second longitudinal side edge opposite the first longitudinal side edge. One of the first and second longitudinal side edges includes a built-in anti-reverse rotation section precluding more than a limited relative degree of movement of the inner coupler and the outer coupler when one of the inner coupler and the outer coupler is subjected to a reverse rotation or an uplift force.

Optionally, each of the first and second longitudinal side edges is curved. The first and second longitudinal side edges may extend helically on the inner coupler or the outer coupler. The built-in anti-reverse rotation section may project discontinuously from the first longitudinal side edge. The built-in anti-reverse rotation section may be formed in the rib, wherein the built-in anti-reverse rotation section has a greater wall thickness than a remainder of the rib. The at least one rib or groove may define only a fractional turn of a helix on the first main body or the second main body, the fractional turn being less than one complete turn. The at least one rib or groove may define only about ¼ turn of a helix on the first main body or the second main body.

As further options, the groove may be oversized relative to the rib, thereby permitting a limited relative motion of one of the inner coupler and the outer coupler with respect to the other of the inner coupler and outer coupler when one of the inner coupler and the outer coupler is subjected to a forward rotation or a reverse rotation. The at least one rib may be formed in the inner coupler. The at least one rib may include four ribs and the at least one groove may include four grooves. The four ribs and the four grooves may be equally spaced from another on the first main body or the second main body.

As still further options, the built-in anti-reverse rotation section defines an anti-reverse rotation stop surface. The anti-reverse rotation stop surface may be curved. The anti-reverse rotation stop surface may extend helically.

The at least one anti-reverse rotation section may define an uplift bearing surface establishing an axial interlock between the inner and outer couplers when one of the inner and outer couplers is subject to a reverse rotation. The uplift bearing surface may extend perpendicularly to a longitudinal axial centerline of the inner coupler or the outer coupler. Each of the inner coupler and the outer coupler may include a built-in anti-reverse rotation section defining an uplift bearing surface, the uplift bearing surface in each of the inner coupler and the outer coupler engaging one another when one of the inner coupler and the outer coupler is subjected to reverse rotation.

Each of the inner coupler and the outer coupler nay include at least one built-in anti-reverse rotation section, the built-in anti-reverse rotation section of the inner coupler receiving the built-in anti-reverse rotation section of the outer coupler when one of the inner coupler and the outer coupler is subjected to reverse rotation. Each of the inner coupler and the outer coupler may include multiple built-in anti-reverse rotation sections distributed on the inner coupler and the outer coupler.

The spring retainer element may be a multiple turn spring element. The multiple turn spring element may complete about three turns on a circumference of the inner coupler and outer coupler.

Each of the inner coupler and the outer coupler may include a plurality of exterior retaining grooves, the plurality of exterior retaining grooves in the respective inner coupler and outer coupler being aligned with one another when the inner coupler and the outer coupler are mated, and the spring retainer element located in the aligned plurality of exterior retaining grooves to complete the axial, snap-lock connection. The built-in anti-reverse rotation section may overhang at least one of the plurality of exterior retaining grooves.

The spring retainer element may be pre-installed on the outer coupler, the spring retainer element automatically engaging an exterior of the inner coupler when the inner coupler and the outer coupler are mated. The foundation support system may further include a cap, a plate, or a lift bracket to support a building foundation in combination with the coupled shaft assembly. The foundation support system may be provided in combination with a grout or cementitious material to enhance a structural strength and capacity of the coupled shaft assembly in the installed foundation support system. The first and second hollow foundation support shafts may be steel shafts. One of the first and second hollow foundation support shafts may include a helical auger. At least one of the inner and outer couplers may be separately fabricated from the first or second hollow foundation support shaft.

Another embodiment of a foundation support system has been disclosed including a coupled shaft assembly. The coupled shaft assembly includes: an inner coupler extending on a first end of a first hollow foundation support shaft, the inner coupler formed with a first main body and at least one of a rib or a groove in the first main body; an outer coupler extending on a second end of a second hollow foundation support shaft, the outer coupler formed with a second main body and at least one of a rib or a groove in the second main body; and a spring retainer element automatically establishing an axial, snap-lock connection between an exterior portion of the inner coupler and the outer coupler when the inner coupler is received in the outer coupler and when the rib is located in the groove to establish a torque transmitting connection between the inner coupler and the outer coupler. The inner coupler and the outer coupler are respectively configured in combination to preclude more than a limited relative degree of movement of the rib within the groove when one of the inner coupler and the outer coupler is subjected to a reverse rotation or an uplift force.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A foundation support system comprising:

a coupled shaft assembly comprising:

an inner coupler extending on a first end of a first hollow foundation support shaft, the inner coupler formed with a first main body having at least one rib or at least one groove;

an outer coupler extending on a second end of a second hollow foundation support shaft, the outer coupler formed with a second main body having at least one rib or at least one groove; and a spring automatically establishing an axial, snap-lock connection between the inner coupler and the outer coupler when the inner coupler is received in the outer coupler and when the at least one rib of one of the inner coupler or the outer coupler is located in the at least one groove in the other of the inner and outer coupler to establish a torque transmitting connection between the inner coupler and the outer coupler;

wherein the at least one rib or at least one groove in each of the inner and outer coupler includes a first longitudinal side edge and a second longitudinal side edge opposite the first longitudinal side edge;

wherein each of the first and second longitudinal side edges extend helically on the inner coupler or the outer coupler; and wherein one of the first and second longitudinal side edges includes a built-in anti-reverse rotation section precluding more than a limited relative degree of movement of the inner coupler and the outer coupler when one of the inner coupler and the outer coupler is subjected to a reverse rotation and/or an uplift force, thereby reducing mechanical shear stress on the spring associated with each of the reverse rotation and the uplift force.

2. The foundation support system of claim 1, wherein the built-in anti-reverse rotation section projects discontinuously from the first longitudinal side edge.

3. The foundation support system of claim 2, wherein the built-in anti-reverse rotation section is formed in the rib, and wherein the built-in anti-reverse rotation section has a greater wall thickness than a remainder of the rib.

4. The foundation support system of claim 1, wherein the at least one rib or at least one groove in each of the inner coupler and the outer coupler defines only a fractional turn of a helix on the first main body or the second main body, the fractional turn being less than one complete turn.

5. The foundation support system of claim 4, wherein the at least one rib or at least one groove in each of the inner coupler and the outer coupler defines only about ¼ turn of a helix on the first main body or the second main body.

6. The foundation support system of claim 1, wherein the at least one anti-reverse rotation section defines an uplift bearing surface establishing an axial interlock between the inner and outer couplers when one of the inner and outer couplers is subject to a reverse rotation.

7. The foundation support system of claim 6, wherein the uplift bearing surface extends perpendicularly to a longitudinal axial centerline of the inner coupler or the outer coupler.

8. The foundation support system of claim 1, wherein the at least one rib or at least one groove in each of the inner coupler and the outer coupler comprises multiple ribs or grooves formed with respective built-in anti-reverse rotation sections distributed on the first main body of the inner coupler and the second main body of the outer coupler.

9. The foundation support system of claim 1, wherein the spring retainer element is a multiple turn spring element having an elastically expandable diameter.

10. The foundation support system of claim 9, wherein the multiple turn spring element completes about three turns around a circumference of the inner coupler and around a circumference of the outer coupler.

11. The foundation support system of claim 1, wherein each of the inner coupler and the outer coupler includes a plurality of exterior retaining grooves, the plurality of exterior retaining grooves in the respective inner coupler and outer coupler being aligned with one another when the inner coupler and the outer coupler are mated, and the spring retainer element located in the aligned plurality of exterior retaining grooves to complete the axial, snap-lock connection.

12. The foundation support system of claim 11, wherein the built-in anti-reverse rotation section overhangs at least one of the plurality of exterior retaining grooves.

13. The foundation support system of claim 1, wherein the spring retainer element is pre-installed on the outer coupler, the spring retainer element automatically engaging an exterior of the inner coupler when the inner coupler and the outer coupler are mated.

14. The foundation support system of claim 1, further comprising a cap, a plate, or a lift bracket to support a building foundation in combination with the coupled shaft assembly.

15. The foundation support system of claim 1, in combination with a grout or cementitious material to enhance a structural strength and capacity of the coupled shaft assembly in the installed foundation support system.

16. The foundation support system of claim 1, wherein the first and second hollow foundation support shafts are steel shafts.

17. The foundation support system of claim 1, wherein one of the first and second hollow foundation support shafts includes a helical auger.

18. The foundation support system of claim 1, wherein at least one of the inner and outer couplers is separately fabricated from the first or second hollow foundation support shaft.

19. A foundation support system comprising:

a coupled shaft assembly comprising:

an inner coupler extending on a first end of a first hollow foundation support shaft, the inner coupler formed with a first main body having at least one rib or at least one groove;

an outer coupler extending on a second end of a second hollow foundation support shaft, the outer coupler formed with a second main body having at least one rib or at least one groove; and a spring automatically establishing an axial, snap-lock connection between the inner coupler and the outer coupler when the inner coupler is received in the outer coupler and when the at least one rib of one of the inner coupler or the outer coupler is located in the at least one groove in the other of the inner and outer coupler to establish a torque transmitting connection between the inner coupler and the outer coupler;

wherein the at least one rib or at least one groove in each of the inner and outer coupler includes a first longitudinal side edge and a second longitudinal side edge opposite the first longitudinal side edge;

wherein the at least one groove is oversized relative to the at least one rib, thereby permitting a limited relative motion of one of the inner coupler and the outer coupler with respect to the other of the inner coupler and outer coupler when one of the inner coupler and the outer coupler is subjected to a forward rotation or a reverse rotation; and wherein one of the first and second longitudinal side edges includes a built-in anti-reverse rotation section precluding more than the limited relative motion of the inner coupler and the outer coupler when one of the inner coupler and the outer coupler is subjected to a reverse rotation and/or an uplift force, thereby reducing mechanical shear stress on the spring associated with each of the reverse rotation and the uplift force.

20. The foundation support system of claim 19, wherein the at least one rib is formed in the inner coupler.

21. The foundation support system of claim 19, wherein the at least one rib comprises four ribs and the at least one groove comprises four grooves.

22. The foundation support system of claim 21, wherein the four ribs and the four grooves are equally spaced from one another on the first main body or the second main body.

23. A foundation support system comprising:

a coupled shaft assembly comprising:

an inner coupler extending on a first end of a first hollow foundation support shaft, the inner coupler formed with a first main body having at least one rib or at least one groove;

an outer coupler extending on a second end of a second hollow foundation support shaft, the outer coupler formed with a second main body having at least one rib or at least one groove; and a spring automatically establishing an axial, snap-lock connection between the inner coupler and the outer coupler when the inner coupler is received in the outer coupler and when the at least one rib of one of the inner coupler or the outer coupler is located in the at least one groove in the other of the inner and outer coupler to establish a torque transmitting connection between the inner coupler and the outer coupler;

wherein the at least one rib or at least one groove in each of the inner and outer coupler includes a first longitudinal side edge and a second longitudinal side edge opposite the first longitudinal side edge;

wherein one of the first and second longitudinal side edges includes a built-in anti-reverse rotation section precluding more than a limited relative degree of movement of the inner coupler and the outer coupler when one of the inner coupler and the outer coupler is subjected to a reverse rotation and/or an uplift force, thereby reducing mechanical shear stress on the spring associated with each of the reverse rotation and the uplift force; and wherein the built-in anti-reverse rotation section defines an anti-reverse rotation stop surface.

24. The foundation support system of claim 23, wherein the anti-reverse rotation stop surface is curved.

25. The foundation support system of claim 23, wherein the anti-reverse rotation stop surface extends helically.

* * * * *